US009392648B2

(12) United States Patent
Jeanneteau et al.

(10) Patent No.: US 9,392,648 B2
(45) Date of Patent: Jul. 12, 2016

(54) METHOD AND DEVICE FOR CONTROLLING AN INDUCTION HEATING COOKING APPARATUS

(75) Inventors: Laurent Jeanneteau, Compiegne (FR); Svend Erik Christiansen, Faenza (IT); Alex Viroli, Forli (IT); Massimo Zangoli, Santarcangelo di Romagna (IT); Thibaut Rigolle, Forli (IT); Mario Barocci, Cesena (IT)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 652 days.

(21) Appl. No.: 13/147,448

(22) PCT Filed: Jan. 20, 2010

(86) PCT No.: PCT/EP2010/000302

§ 371 (c)(1),
(2), (4) Date: Aug. 2, 2011

(87) PCT Pub. No.: WO2010/097143

PCT Pub. Date: Sep. 2, 2010

(65) Prior Publication Data

US 2011/0297669 A1 Dec. 8, 2011

(30) Foreign Application Priority Data

Feb. 26, 2009 (EP) ..... 09002713

(51) Int. Cl.
*H05B 6/04* (2006.01)
*H05B 6/06* (2006.01)

(52) U.S. Cl.
CPC ... *H05B 6/06* (2013.01); *H05B 6/04* (2013.01)

(58) Field of Classification Search
CPC ..... H05B 6/12; H05B 6/1209; H05B 6/04; Y02B 40/126
USPC ..... 219/621, 624, 660, 622, 670
See application file for complete search history.

(56) References Cited

U.S. PATENT DOCUMENTS 5,488,304 A * 1/1996 Hamade et al. ..... 324/520
6,346,800 B1 * 2/2002 Mano et al. ..... 323/282

(Continued)

FOREIGN PATENT DOCUMENTS

CN 1529996 A 9/2004
EP 1420613 5/2004

(Continued)

OTHER PUBLICATIONS

Machine Translation of Watanabe et al: Oct. 2014.*

(Continued)

*Primary Examiner* — Dana Ross
*Assistant Examiner* — Hemant Mathew
(74) *Attorney, Agent, or Firm* — Pearne & Gordon LLP

(57) ABSTRACT

A method for controlling an induction heating cooking apparatus, comprises the steps of a) transforming a supply current ($I_{in}$) having a base frequency, for example 50 Hz or 60 Hz, into an induction current ($I_w$) having a higher frequency than the base frequency of the supply current, b) feeding the induction current into at least one inductor of the induction heating cooking apparatus to generate a magnetic induction field, c) detecting a deviation or distortion of the actual shape or frequency spectrum of the supply current or a rectified supply current from a predetermined admissible shape or frequency spectrum lying outside of a pre-given tolerance range, d) adapting the induction current or the electrical power associated with the induction current until the detected deviation or distortion of the actual shape or frequency spectrum of the supply current or a rectified supply current from the predetermined shape or frequency spectrum lies within the pre-given tolerance range again.

15 Claims, 1 Drawing Sheet

(56) References Cited

U.S. PATENT DOCUMENTS

| | | | | |
|---|---|---|---|---|
| 2005/0006380 | A1* | 1/2005 | Kagan | 219/661 |
| 2007/0247078 | A1* | 10/2007 | Kwon | 315/200 R |
| 2010/0176120 | A1* | 7/2010 | Watanabe et al. | 219/624 |
| 2011/0168697 | A1* | 7/2011 | Kazama et al. | 219/660 |

FOREIGN PATENT DOCUMENTS

| | | | |
|---|---|---|---|
| EP | 1734789 | | 12/2006 |
| JP | 2005-50624 | A | 2/2005 |
| JP | WO2008155923 | * | 12/2008 |
| WO | WO 2008155923 | A1 * | 12/2008 |

OTHER PUBLICATIONS

WO 2008/155923 Machine Translation, Watanabe, Kenji, Induction Heating Cooker, Dec. 24, 2008.*

International Search Report for PCT/EP2010/000302, dated Sep. 27, 2010, 2 pages.

Translation of Office Action in Chinese Patent Application No. 201080009311.4, dated Dec. 3, 2012.

* cited by examiner

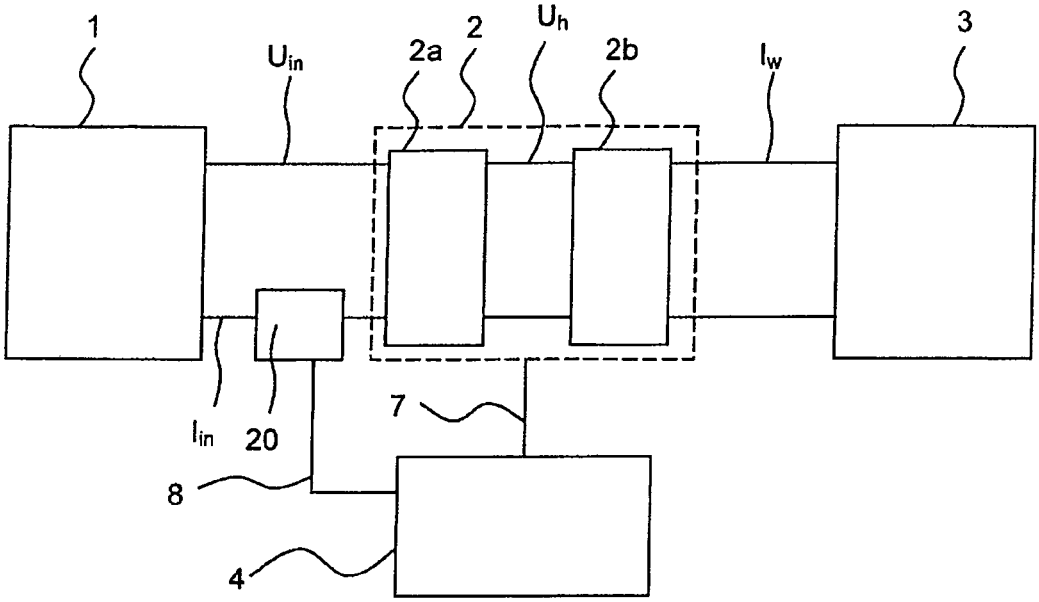
1
$U_{in}$
2a
2
$U_h$
2b
$I_w$
3
$I_{in}$
20
7
8
4

METHOD AND DEVICE FOR CONTROLLING AN INDUCTION HEATING COOKING APPARATUS

The present invention relates to a method and a device each for controlling an induction heating cooking apparatus.

In an induction heating cooking apparatus a magnetic field or induction filed is generated in order to induce eddy currents in the object to be heated which is electrically conducting and mostly also ferromagnetic, for instance a bottom of a cooking vessel or pot on an induction heating hob. The induction or magnetic field is generated by an induction generator. At first the alternating current or voltage from the AC power supply system which is of sinusoidal shape with both polarities and has, therefore, one base frequency, typically 50 Hz in Europe, is rectified to a direct current or voltage (DC) having sinusoidal half waves of only one polarity by a rectifier. Then the direct current or voltage is switched by an inverter comprising electronic switching elements such as e.g. transistors or Triacs in order to generate an induction current with one polarity with pulses which are usually subjected to electronic smoothing e.g. by means of capacitors and have a frequency between typically 10 kHz up to 60 kHz (HF induction current) corresponding to the switching frequency of the electronic switching elements and their switching pulses (in the switched-on-state). The induction current, therefore, comprises the smoothened high frequency pulses of the high switching frequency within the sinusoidal basic or envelope shape of the former low frequency current (50 Hz). This HF induction current is fed into an as and inductor usually an induction coil and induces there the HF magnetic induction field. The reason for this transformation of the low frequency power grid current into a HF induction current is the by far higher efficiency of the induction heating at the higher frequencies for the same electrical power input.

However, some non-linear effects may occur in the heated object during induction heating, in particular a heated cooking vessel or pot on the induction hob. The intensity of the non-linear correlations depends on the material and the construction of the object. For example, such non-linear correlations occur in a pot with enamelled steel, not so much in a pot made of cast iron. Further, the induction generator generates harmonics, which are increased by the aforementioned non-linear effects in the object. The intensity of the harmonics is, however, regulated by law and may not excess a predetermined limit. Furthermore, the shape of the supply current and thus of the envelope of the induction current will in this case not sinusoidal any more. In other words, the correlation between the supply current and the supply voltage as well as between the induction current and the induction voltage has a non-linearity, which results in additional harmonics. The additional harmonics generated by such non-linearities increase with increasing power and exceed the allowed limits typically at a power of more than about 3.3 kW.

So, either the power is kept below the 3.3 kW or the harmonics can be reduced in a different way, allowing for the power to be higher.

DE 10 2005 028 829 A1 describes a method of varying the switching frequency of the switching elements of the inverter within the half-wave of the supply voltage for an induction generator of an induction heating cooking apparatus. At the zero crossings of the supply voltage the frequency is on a base value. During the half-wave of the supply voltage between two zero crossings the frequency is increased and decreased again back to the base frequency. The frequency is varied in order to obtain substantially constant impedance. Said constant impedance allows for a linear relationship between the supply current and the supply voltage and the supply current as well as the envelope shape of the induction current has a sinusoidal form and harmonics are reduced. The impedance can also be detected and the frequency controlled so that the impedance remains substantially constant.

The frequency variation of this known method results in an improvement of the power output of the induction generator.

It is an object of the present invention to provide an improved method and an improved device each for controlling an induction generator of an induction heating cooking apparatus.

This object is achieved by the method according to claim 1 and the device according to claim 9.

The method for controlling an induction heating cooking apparatus according to a first aspect of the invention comprises the steps of a) transforming a supply current having a base frequency, for example a power grid or mains frequency of 50 Hz or 60 Hz, into an induction current having a higher frequency than the base frequency of the supply current, for example high frequency between 10 kHz and 60 kHz, b) feeding the induction current into at least one inductor of the induction heating cooking apparatus to generate a magnetic induction field, c) detecting a deviation or distortion of the actual shape (in particular in the time space or as a function of time) or frequency spectrum (in the frequency space or as a function of frequency) of the supply current or a rectified supply current from a predetermined admissible shape or frequency spectrum lying outside of a pre-given tolerance range, d) adapting the induction current or the electrical power associated with the induction current until the detected deviation or distortion of the actual shape or frequency spectrum of the supply current or a rectified supply current from the predetermined shape or frequency spectrum lies within the pre-given tolerance range again.

The device for controlling an induction heating cooking apparatus according to a second aspect of the invention comprises a) an induction generator having a frequency converter and at least one inductor wherein the frequency converter transforms a supply current having a base frequency, for example 50 Hz or 60 Hz, at its input into an induction current having a higher frequency than the base frequency of the supply current at its output and feeds the induction current into the at least one inductor to generate a magnetic induction field, c) a controlling device for c1) detecting a deviation or distortion of the actual shape or frequency spectrum of the supply current or a rectified supply current rectified by a rectifier from a predetermined admissible shape or frequency spectrum lying outside of a pre-given tolerance range and for c2) adapting the induction current or the electrical power associated with the induction current at the output of the frequency converter until the detected deviation or distortion of the actual shape or frequency spectrum of the supply current or a rectified supply current from the predetermined shape or frequency spectrum lies within the pre-given tolerance range again.

The present invention is based on the idea to analyse or monitor the supply or mains current for an induction cooking apparatus without, before or after rectification, and to detect if or when the shape or spectrum is not in accordance with a previously determined admissible or still acceptable shape within a preset tolerance range, in particular whether harmonics or non-linear correlations occur which exceed pre-given tolerances. The invention is based on the further idea to adapt or control the induction current of the induction generator in such a way that the distortion or deviation from the pre-set shape or spectrum is brought back into the tolerance range. In other words, a feedback is introduced between the supply current on one side, rectified or not, and the induction current or the induction power output on the other side to reduce or keep the shape or spectrum and in particular the level of the harmonics within pre-given tolerances.

It is clear that in all embodiments instead of analysing or monitoring the supply current or rectified supply current (directly) it is also understood by the skilled person that alternatively the supply voltage or rectified supply voltage can be analysed or monitored as it is correlated to the supply current or rectified supply current so that this embodiment is to be considered to fall within the meaning and scope of claim 1 also.

Further embodiments according to the invention can be obtained from the dependent claims.

In a preferred embodiment the supply current or rectified supply current is measured, in particular by a current transducer (or: current transformer) and sampled and the sampled measured values are stored and used for representing the actual shape of frequency spectrum of the supply current or a rectified supply current or, after transformation or analysis, in particular spectral transformation or analysis such as Fourier transformation, e.g. FFT, or analysis, for obtaining values for the actual shape of frequency spectrum in said step of detecting a deviation or distortion together with stored values representing the predetermined shape or frequency spectrum. A corresponding measure for the comparison or the determination of the deviation is also stored and applied.

In one embodiment the supply current is transformed into the induction current by switching the supply current or the rectified supply current by switching means, such as electronic switches, with at least one switching frequency (or: driving frequency) to generate the induction current wherein smoothing of the switched pulses, in particular by capacitors, is usually provided.

It is then possible to adapt the induction current or the electrical power associated with the induction current by modifying or varying the switching frequency, in particular during a half wave or half period of the supply current or supply voltage, accordingly a half wave, but full period of the rectified supply current or supply voltage. In particular, the frequency is increased and decreased again over a half wave of the supply voltage or supply current However, instead of modifying the switching frequency, also other ways of adapting the shape or spectrum of the supply current by means of modifying the induction current can be applied such as changing the duty-cycle of the switching means, especially in the way that the switching means are driven asymmetrical.

The adapting of the induction current or the electrical power associated with the induction current can be performed cyclic and/or in a cycle, with the base frequency of the supply current or a supply voltage associated therewith.

Alternatively or aditionally, the adapting the induction current or the electrical power associated with the induction current is performed continuously.

Preferably, the adapting of the induction current is performed asymmetrically each half wave, wherein preferably the cycle is repeated at each complete cycle.

The detecting of a deviation or distortion, in particular the measuring and sampling of the supply current or the rectified supply current, is preferably performed over the period of a supply voltage or a rectified supply voltage or the supply current or the rectified supply current.

In particular, the power associated with the induction current generator is varied or variable within the half-wave or half period of the supply voltage or supply current around a power basic value in such a way, that at the zero crossing of the supply voltage or supply current the power request is higher than the power basic value and at the peak of the supply voltage or supply current the power request is lower than the power basic value.

This variation of the power can be performed in parallel or in addition to a switching frequency variation. Preferably, the base frequency is adapted at the same time.

Preferably the feedback or adapting of the induction current or induction power output is such that the harmonics are minimised and the power output is maximised and/or that the shape of the supply current is as close as possible to a sinusoidal shape or the frequency spectrum of the supply current as close as possible to only one single value, namely the base frequency, and/or that the intensity of the harmonics induced in the supply current or voltage by the induction generator and the inductively heated cooking vessel are limited and kept below the allowed values. In other words, an optimal compensation of the non-linear correlations generated by cooking vessels should be obtained.

The induction heating cooking apparatus is in particular an induction cooking hob, but can also be an induction cooing oven.

The method according to the present invention may be realized in hardware, software or a combination of hardware and software.

The invention will be further described with reference to the drawing having only one FIG. 1 showing a block diagram of a device according to the invention.

FIG. 1 shows a block diagram of a device according to the invention, with an electrical AC source 1 (or: power grid, mains supply), supplying an electrical supply voltage $U_{in}$ and corresponding electrical supply current $I_{in}$ as input to a frequency converter 2. The supply voltage $U_{in}$ and supply current $I_{in}$ have (ideally) one single frequency as a base frequency, typically 50 Hz such as in Europe or 60 Hz in USA or e.g. 400 Hz for use in boats or for camping, and, thus, they are of sinusoidal shape or are sinus functions of time. The voltage amplitude of $U_{in}$ is typically about 230 V or about 110 V.

The output current $I_w$ of the frequency converter 2 is an induction current passed or fed to the inductor 3, which typically comprises at least one induction coil.

The induction current $I_w$ is a HF current, which is typically generated by switching the supply current $I_{in}$ at a high switching or driving frequency Inside the frequency converter 2, the input voltage signal $U_{in}$ is first rectified in the rectifying unit 2*a*, e.g. a rectifying diode bridge, to a voltage signal $U_h$ (rectified supply voltage) containing the positive or rectified half waves of the input voltage signal $U_{in}$. After that, the high frequency induction current $I_w$ with a working (or: switching or driving) frequency $f_W$ is generated in the inverter unit 2*b*, for example using controlled semiconductor or electronic switching devices such as transistors, Triacs, IGBT etc. in a half bridge circuit or a full bridge circuit or a single switch. The behaviour of the frequency converter 2 is controlled by a controlling device 4 which is connected to the frequency converter 2 by a control line 7.

Furthermore, a signal input of the controlling device 4 is connected to the signal output of a current transformer (or: current transducer) 20 by a signal line 8. The current transformer 20 measures the supply current $I_{in}$ between the output of the AC source 1 and the input of the frequency converter 2. The controlling device 4 samples the measured values at a pre-given sampling rate, e.g. at or around 10 kHz, and determines by a given pattern, characteristic value or spectral analysis whether the shape or the frequency spectrum of the supply current is within given tolerances close enough to a pre-given admissible shape or spectrum, which corresponds to a pre-determined admissible level of harmonics. If an inadmissible deviation or distortion outside of the tolerance range is detected, the shape or spectrum of the supply current $I_{in}$ is adapted or modified by changing the power output or the induction current $I_w$ of the frequency converter 2, in particular the inverter unit 2*b*.

In particular, the working or switching frequency $f_W$ of the inverter 2*b* and thus of the induction current $I_w$ can be changed during a half-wave of the supply current $I_{in}$ or supply voltage $U_{in}$ by detecting the zero crossings of the supply current $I_{in}$ or supply voltage $U_{in}$ and modifying the working frequency $f_W$ between two subsequent zero crossings, in particular increasing the frequency and then decreasing it again, in particular continuously from at least one base value at the zero crossing to a maximum value preferably at the maximum of the supply current or voltage and back again.

In addition or alternatively to this frequency variation, the power output of the frequency converter 2 is modified during a half wave.

To vary the frequency, the duty-cycle of the output signal of the switching means can be changed. In case the switching means is an IGBT half-bridge driven by a pulse-width-modulated signal (pwm signal), for example, the pwm signal that drives the IGBT half-bridge can be changed, for example in the way that the half-bridge is driven asymmetrically.

LIST OF REFERENCE NUMERALS

1 AC source
2 frequency converter
2*a* rectifying unit
2*b* inverter unit
3 inductor
4 controlling device
7 control line
8 signal line
20 current transformer
$U_{in}$ supply voltage
$I_{in}$ supply current
$I_w$ induction current
$U_h$ rectified supply voltage
$f_W$ working frequency

The invention claimed is:

1. A method for controlling an induction heating cooking apparatus, comprising the steps of a) transforming a supply current ($I_{in}$) having a base frequency into an induction current ($I_w$) having a higher frequency than a base frequency of the supply current, b) feeding the induction current into at least one inductor of the induction heating cooking apparatus to generate a magnetic induction field, c) detecting during induction heating a distortion of an actual shape of the supply current from a predetermined admissible shape of the supply current set within a pre-given tolerance range by:

c1) measuring values of the supply current; and c2) comparing the actual shape of the supply current with the predetermined admissible shape of the supply current; and d) adapting the induction current or an electrical power associated with the induction current until the actual shape of the supply current is brought back within the pre-given tolerance range.

2. The method according to claim 1, wherein the supply current is measured and sampled and the sampled measured values are stored and used for representing the actual shape of the supply current or, after spectral analysis, for obtaining values for the actual shape in said step of detecting a distortion together with stored values representing the predetermined admissible shape.

3. The method according to claim 1, wherein in said step of transforming the supply current into the induction current, the supply current is switched by switching means with at least one switching frequency to generate the induction current, wherein smoothing of switched pulses is performed by capacitors.

4. The method according to claim 3, wherein in said step of adapting the induction current, or the electrical power associated with the induction current, the switching frequency is modified or varied during a half wave or half period of the supply current.

5. The method according to claim 1, wherein said step of adapting the induction current or the electrical power associated with the induction current is performed cyclic with the base frequency of the supply current or a supply voltage associated therewith.

6. The method according to claim 1, wherein said step of adapting the induction current or the electrical power associated with the induction current is performed continuously.

7. The method according to claim 1 wherein said step of detecting a distortion of the actual shape of the supply current is performed over a period of a supply voltage or the supply current.

8. The method according to claim 1, wherein the electrical power associated with the induction current is varied or variable within a half-wave or half period of a supply voltage or the supply current around a power basic value in such a way, that at a zero crossing of the supply voltage or the supply current, a power request is higher than the power basic value and at a peak of the supply voltage or the supply current, the power request is lower than the power basic value.

9. The method according to claim 1, wherein the supply current is rectified.

10. The method according to claim 1, wherein the distortion of the actual shape of the supply current is caused by a non-linearity in a correlation between the supply current ($I_{in}$) and a supply voltage associated with the supply current ($I_{in}$), and between the induction current ($I_w$) and an induction voltage associated with the induction current ($I_w$).

11. The method according to claim 2, wherein the spectral analysis is a Fourier analysis.

12. A method for controlling an induction heating cooking apparatus, comprising the steps of a) transforming a supply current ($I_{in}$) having a base frequency into an induction current ($I_w$) having a higher frequency than the base frequency of the supply current, b) feeding the induction current into at least one inductor of the induction heating cooking apparatus to generate a magnetic induction field, c) detecting during induction heating a deviation of a frequency spectrum of the supply current from a predetermined admissible frequency spectrum set within a pre-given tolerance range by:

c1) measuring values of the supply current; and c2) comparing the frequency spectrum of the supply current with the predetermined admissible frequency spectrum; and d) adapting the induction current or an electrical power associated with the induction current until the frequency spectrum of the supply current is brought back within the pre-given tolerance range.

13. The method according to claim 12, wherein the supply current is measured and sampled and the sampled measured values are stored and used for representing the frequency spectrum of the supply current or, after spectral analysis, for obtaining values for the frequency spectrum in said step of detecting a deviation together with stored values representing the predetermined admissible frequency spectrum.

14. The method according to claim 13, wherein the spectral analysis is a Fourier analysis.

15. The method according to claim 12, wherein the supply current is rectified.

* * * * *